US005621387A

United States Patent [19]

Phillips et al.

[11] Patent Number: 5,621,387

[45] Date of Patent: Apr. 15, 1997

[54] BOX

[75] Inventors: Kirk B. Phillips, Wilkesboro; Patrick K. Strong, Icard; J. Michael McRee, Newton; David C. Steele, Taylorsville, all of N.C.

[73] Assignee: Elk Products, Inc., Hildebran, N.C.

[21] Appl. No.: 512,664

[22] Filed: Aug. 8, 1995

[51] Int. Cl.[6] ..... G08B 13/14

[52] U.S. Cl. ..... 340/568; 340/693; 340/686; 340/687; 340/541; 220/3.8; 220/4.02; 220/337; 361/600; 361/641; 361/246; 206/701; 174/52.1

[58] Field of Search ..... 340/541, 568, 340/572, 693, 686, 687; 220/3.8, 4.02, 337; 361/600, 641, 246; 174/52.1, 50; 206/701

[56] References Cited

U.S. PATENT DOCUMENTS

| | | | |
|---|---|---|---|
| 1,692,064 | 11/1928 | Trogner | 174/52.1 |
| 2,754,498 | 7/1956 | Lavelle | 340/568 |
| 3,192,517 | 6/1965 | Werlin | 340/568 |
| 3,444,547 | 5/1969 | Surek | 340/568 |
| 3,752,900 | 8/1973 | Harrison et al. | 174/50 |
| 4,037,223 | 7/1977 | Tucci et al. | 340/568 |
| 4,121,201 | 10/1978 | Weathers | 340/568 |
| 4,149,158 | 4/1979 | Iwaoka et al. | 340/568 |
| 4,158,102 | 6/1979 | Bright | 174/52.1 |
| 4,531,116 | 7/1985 | Takagi et al. | 340/568 |
| 4,791,244 | 12/1988 | Taybl | 174/52.1 |
| 4,805,073 | 2/1989 | Johnson et al. | 174/52.1 |
| 5,141,123 | 8/1992 | Onodera | 220/4.02 |
| 5,398,833 | 3/1995 | Klauss et al. | 220/4.02 |
| 5,456,377 | 10/1995 | Williams, Jr. | 220/4.02 |

*Primary Examiner*—Thomas Mullen
*Assistant Examiner*—Benjamin C. Lee
*Attorney, Agent, or Firm*—Bell, Seltzer, Park & Gibson, P.A.

[57] ABSTRACT

A box for covering components or the like and for preventing unwanted access thereto. The box comprises a mounting panel having a pair of opposed sides, a top portion, a bottom portion and a back portion. The back portion is adapted to receive a fastener for mounting the mounting panel to a mounting surface. A cover fastener is received within the mounting panel. A slot is formed in the mounting panel and a corresponding tang is located within the cover which is adapted to receive an alarm device therein and removably envelop the mounting panel. A second opening is located in the cover for receiving the cover fastener when said mounting panel is enveloped within the cover. The slot and the tang selectively movably cooperate with each other to enable the cover to initially envelop the mounting panel and subsequently secure the cover to the mounting panel as the cover fastener draws the cover toward the mounting panel, preventing the cover from being removed from the mounting panel without removal of the cover fastener. A circuit board is mounted within one of the mounting panel and the cover and is biased toward an ARMED position. The circuit board and the cover fastener cooperate to detect unauthorized tampering or attempts to remove the cover from the wall. When such activity is detected, an alarm electrically connected to the circuit board is activated.

13 Claims, 3 Drawing Sheets

BOX

FIELD OF THE INVENTION

This invention relates to security or alarm boxes of the type used in housing security alarm components, and to an improved construction of same.

BACKGROUND OF THE INVENTION

Alarm or security boxes have long been used to house personal items or elements of an alarm system such as speakers and electrical components. Many of the existing security boxes have a hinged front plate which, when unlocked, opens to allow access to the interior portion of the box. Unfortunately, by their very nature, security boxes are often placed in confined spaces such as in corners between adjoining walls or adjacent other obstructions which limits the ability of the hinged plate to swing fully open. Consequently, access to the components contained within the security box may be obstructed making installation, replacement and/or repair of the components difficult.

Security boxes have traditionally been mounted to an mounting surface by conventional fasteners such as rivets, screws or bolts. In addition, the hinged panel has been mounted to the body of the security box by screws or bolts. These fasteners are both difficult to install and do little to prevent unauthorized access to the components housed within the box. Furthermore, by using a number of screws to hold the mounting panel and the cover together increases the likelihood that a screw will be dropped and lost during installation, repair and/or during routine maintenance.

To resist tampering, security boxes have typically relied on modifying the screws which secure the hinged front plate to the body of the box. Such modifications include providing uniquely shaped heads which can only be inserted and removed by use of a special tool. Security boxes have in the past also been provided with a variety of locking mechanisms ranging from key locks integrally formed within the security box to the addition of heavy gauge padlocks. In addition, security boxes have also used plunger-type tamper switches. Such plunger-type tamper switches are however only capable of detecting actual unauthorized access to the box, but are unable to detect unauthorized attempts to gain access to the components contained within the box. Consequently, the plunger-type switch only detects the damage after it has occurred but does not warn or deter attempts at unauthorized access as it is occurring to minimize the potential risk of successful access and minimize the potential damage and/or loss of the items housed within the box.

These tamper resistance efforts have focused primarily on making it mechanically more difficult to gain access to the contents of the security box through the use of special fasteners and by making the box from stronger materials. Unfortunately, such approaches to constructing security boxes have made authorized access for repair, replacement and routine maintenance of components contained within the security box more difficult and often more expensive through the requirement of special tools.

SUMMARY OF THE INVENTION

With the foregoing in mind, it is an object of the present invention to produce a box which is both easier to install and gain authorized access to for maintenance and repair. It is a further object of the present invention to provide an improved, box having enhanced tamper resistance without a substantial increase in the cost.

These and other objects, features, and advantages of the present invention are obtained by providing a box adapted to house components or the like and prevent unwanted access thereto. The box comprises a mounting panel adapted to be secured to a mounting surface. A cover cooperates with the mounting panel to form an enclosure. A cover fastener engages both the mounting panel and the cover to secure the cover to the mounting panel. An alarm device is mounted within said enclosure and a trigger mechanism is operably connected to the alarm device for activating the alarm device in response to unauthorized tampering of either the mounting panel and/or the cover. The trigger mechanism including means responsive to attempted removal of the cover fastener and also responsive to attempted detachment of the mounting panel from a mounting surface.

The trigger mechanism preferably includes a trigger member having one end thereof pivotally connected to the mounting panel, thereby allowing the trigger member to float, i.e., be easily angularly displaced. An adjustment member is preferably provided for biasing the trigger member into engagement with the cover fastener. A switch is operatively connected to the trigger member so as to activate the alarm device when the cover fastener is moved away from the switch in response to at least partial removal i.e., unthreading of the cover fastener. In addition, the trigger member also activates the alarm device when the trigger member and switch are angularly displaced, causing them to move away from the cover fastener in response to at least a portion of the mounting panel being moved away from the mounting surface.

The trigger mechanism preferably has a microswitch attached thereto and is electronically connected to the alarm device. The microswitch has a biasing member projecting therefrom for engaging the mounting surface to which the mounting panel is secured. The biasing member is a lever carried by the trigger and having a portion thereof projecting from the mounting panel for engaging the mounting surface to which the mounting panel is secured. The biasing member biases the movable trigger to a position in which the switch is engaged by the cover fastener so that either detachment of the mounting panel from its mounting surface or movement of the cover fastener away from the switch will result in disengagement of the switch and resulting activation of the alarm device.

Another component of the box is a connecting means for releasably connecting the cover and the mounting panel. The connecting means includes a tang or a pair of tangs located on opposite side portions of the cover and a corresponding slot or pair of slots located on opposite side portions of the mounting panel. Each slot has a first portion extending generally perpendicular to the face of the mounting panel for receiving the tang and providing an interconnection between the cover and the mounting panel upon movement of the cover in a first direction generally toward the face of the mounting panel. The slot has a second portion connected to the first portion for slidably receiving the tang from the first portion. The second portion of the slot extends generally parallel to the face of the mounting panel for permitting movement of the cover in a second direction generally parallel to the face of the cover and into a locked position preventing the cover from being removed from the mounting panel.

The slot has a stepped, generally U-shaped configuration such that relative movement of the tang and the slot enables the cover to initially engage the mounting panel and then subsequently move vertically relative thereto to secure the cover to the mounting panel. A generally L-shaped or U-shaped slot is preferred in that such a shape allows both horizontal and vertical movement of the cover relative to the mounting panel. The slot also preferably includes a blocking tab to separate the slot into a first section and a second section and prevent relative movement of the slot and the tang between the first and second sections without first relative movement parallel to the mounting surface.

The microswitch is biased to the OPEN position to ensure that any attempt to remove the cover from the mounting panel through removal of the cover fastener activates the alarm device electronically connected thereto. The use of the floatingly mounted trigger member which is biased away from the mounting surface to which the panel is mounted is also preferred because any attempt to pry the box from the mounting surface causes the microswitch to move to the OPEN position and thereby activate the alarm. Unlike previous attempts to prevent tampering of the box, the present invention uses the combination of the microswitch in conjunction with the floating trigger member and the cover fastener to electronically ward off tampering by activation of an audible alarm device, a silent alarm device to a central location, and activation of emergency lighting or a combination of any of these or similar elements.

The lever has a bulbous head which has the advantage that even sight movement of the cover fastener, such as by unthreading the cover fastener as little as three turns, causes the cover fastener to move away from the lever. As the cover fastener moves away from the lever, the lever moves from the CLOSED position toward the OPEN position and activates the alarm device, well before the cover can be removed from the mounting panel. A similar benefit is obtained with respect to the floatingly mounted trigger member. Even the slightest movement of any corner of the mounting panel from the mounting surface causes the trigger member and the attached microswitch to move away from the cover fastener, again causing activation of the alarm device well before the box can be pried from the mounting surface.

This focus on electronic methods of tamper resistance rather than traditional mechanical components enables the box to have a simple construction which is both easy to install and provides easy access for purposes of maintenance. In addition, the early activation of the alarm device increases the likelihood that the box and the components contained therein will not be destroyed before the individual seeking unauthorized access is deterred.

The cover and the mounting panel preferably use a cooperative tang and slot arrangement which allows the cover to be completely removed from the mounting panel. As a result, the components of the box are completely exposed for purposes of installation, repair or replacement. Furthermore the box can be installed in confined spaces without sacrificing access to the components contained therein.

The fastener and the cover fastener used to respectively mount the mounting panel to the mounting surface and releasably secure the cover to the mounting panel are preferably conventional fasteners such as screws, bolts or the like. The advantage of using conventional fasteners, which do not have specialized heads, is that no special tools are required to be used for installation and/or maintenance. In addition, in the event that one of the fastener or the cover fastener is lost, it is easily and inexpensively replaced. Preferably the threaded cover fastener threadably engages the mounting panel and the cover for securing the cover to the base. The threaded fastener is so oriented as to cause the cover to be moved in the second direction toward the locked position upon rotation of the threaded fastener in a predetermined direction of rotation.

Preferably the cover is a unitary construction thereby avoiding the need to use screws, rivets, bolts, etc. to secure the top portion, the bottom portion, the sides and the back portion together. Instead, the cover may be welded or the like to limit any location for unwanted access to the box.

BRIEF DESCRIPTION OF THE DRAWINGS

Some of the objects and advantages of the present invention having been stated, others will become apparent as the description proceeds when taken in conjunction with the accompanying drawings, in which.

DETAILED DESCRIPTION OF THE PREFERRED EMBODIMENTS

The present invention now will be described more fully hereinafter with reference to the accompanying drawings, on in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
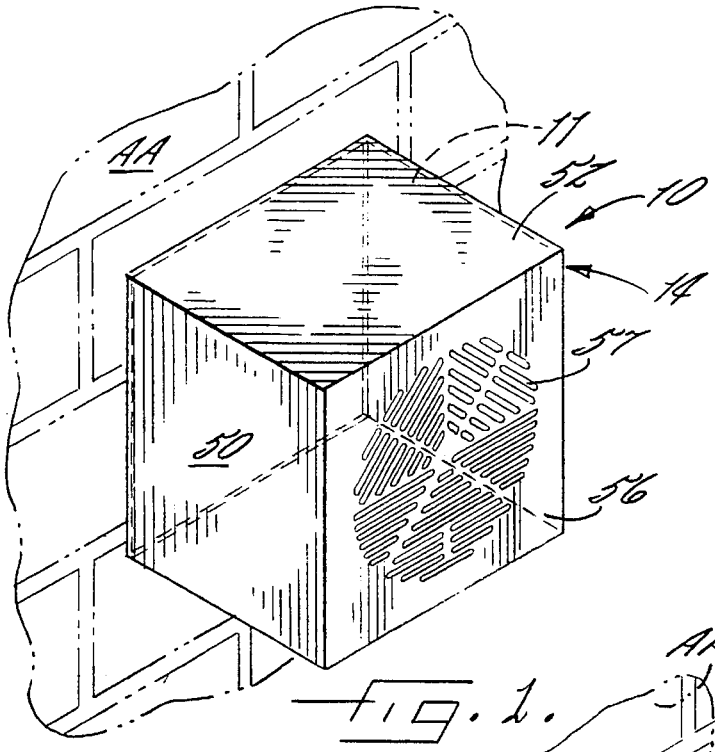
FIG. 1 is side view in perspective of the box mounted to an adjacent wall in accordance with one embodiment of the invention.

Referring more particularly to the drawings, FIG. 1 illustrates a box generally indicated as 10 of the present embodiment mounted to an mounting surface AA, in this instance a brick wall. The box 10, as shown in FIG. 2, includes a mounting panel generally indicated as 12, a cover generally indicated as 14, a trigger mechanism generally indicated as 16, and an alarm device, in this instance a speaker, generally indicated as 18.

Figure 2:
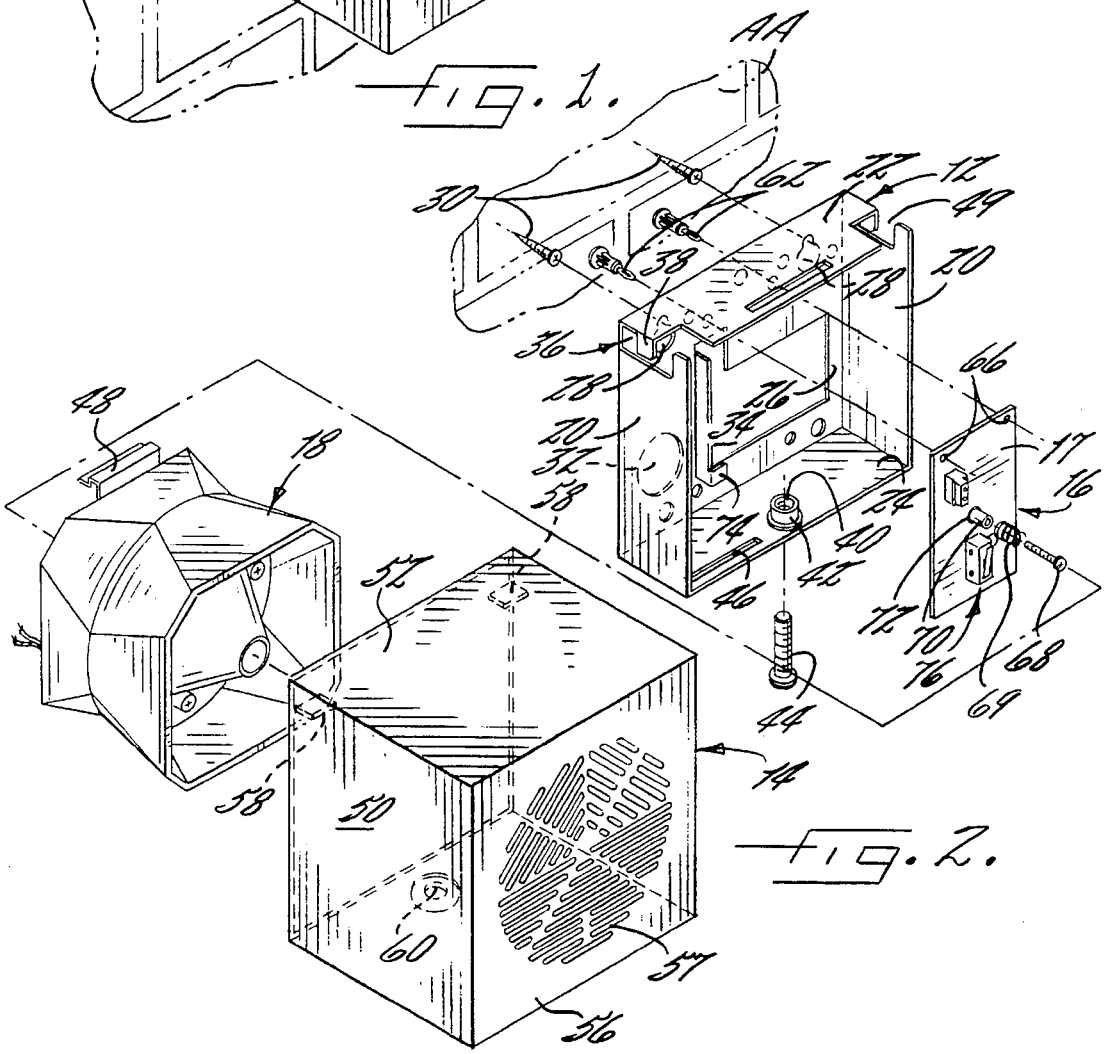
FIG. 2 is an exploded view of the box shown in FIG. 1.
Figure 3:
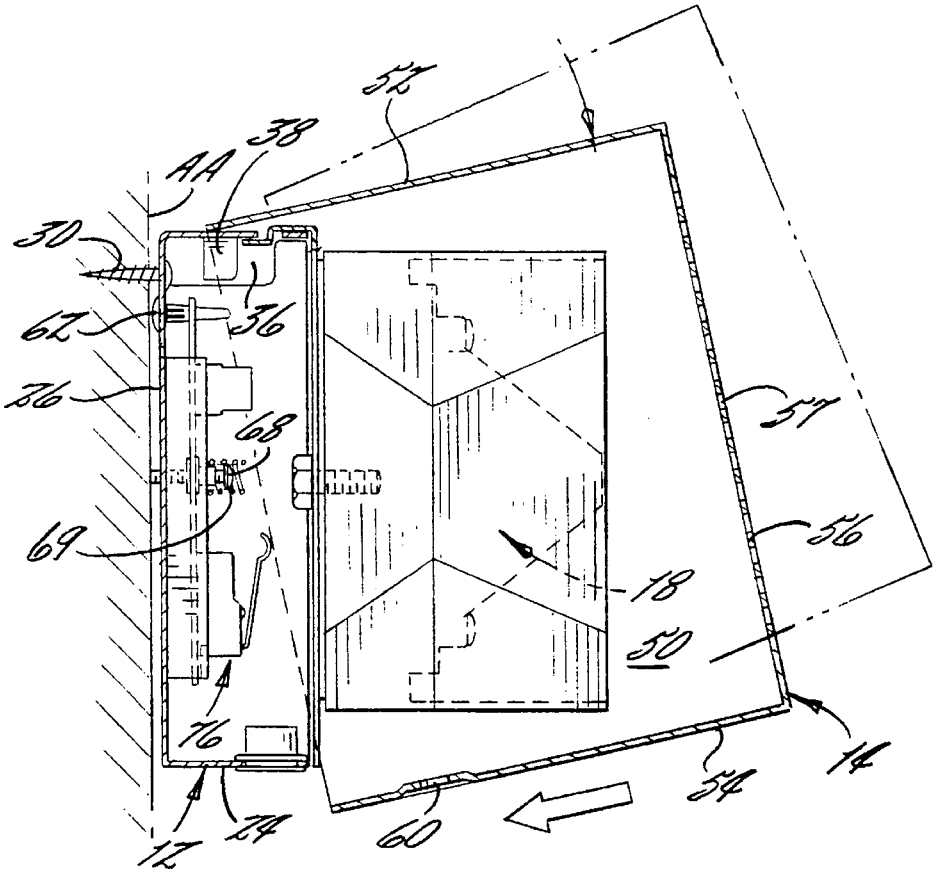
FIG. 3 is a side view partially in cross section showing the mounting panel secured to the wall and showing the cover as it is being positioned on the mounting panel.

As may be seen in FIGS. 2 and 3, the mounting panel 12 has a generally square configuration formed from a pair of opposed sides 20, a top portion 22, a bottom portion 24, and a back portion 26. The back portion defines at least one, in this embodiment, two keyhole shaped apertures 28 which are adapted to receive a conventional fastener, in this case screws 30 for securely mounting the mounting panel 12 to the adjacent wall AA. As shown, the mounting panel also defines another aperture 32 for receiving the electrical wiring (not shown) of the box 10. Adjacent aperture 32 is a generally rectangular aperture 34 which cooperates with the trigger mechanism 16 in a manner described in detail below.

A slot 36 is formed in each of the opposed sides 20. Each slot 36 has a stepped or generally U-shaped configuration when seen in side view. A generally rectangular blocking tab 38 extends downward into each slot 36 so as to divide each slot into a first or introduction section **36*a* and a second or locking section 36*b*. It is to be understood that the location and the configuration of the slot 36 may be varied and still remain within the spirit of the invention. For example, the slot would also work effectively with an L-shaped configuration, a bayonet slot configuration or a similar shape so long as the cover 14 is capable of being either longitudinally (vertically) or transversely (horizontally) movable relative to the mounting panel 12** in at least in one portion of the slot. In addition, it is also possible to practice the present invention with only one slot and one correspondingly located tang.

The bottom portion 24 of the mounting panel 12 defines a first opening 40, in this instance in the form of a generally circular hole having an insert 42 fitted therein to threadingly receive a cover fastener 44. An elongated cutout 46 is formed in each of the top portion 22 and the bottom portion 24 to selectively receive a mounting bracket 48 of the speaker 18. When in use, the mounting bracket 48 of the speaker 18 is positioned in the elongated cutout 46 in the top portion 22. The elongated cutout 46 in the bottom portion 24 allows the speaker 18 to be removed from top portion 22 of the mounting bracket 12, while remaining electrically connected, and be positioned on the bottom portion 24 of the mounting bracket to provide access to the other components contained within the box 10. A cutout or cutaway 49 is formed in at least one end of the top portion 22 to correspond in size and location to the slot 36. The purpose of the cutaway 49 will be described in greater detail below.

The cover 14, as best shown in FIGS. 1 through 3, has a generally square configuration of a size sufficient to form an enclosure 11 with the mounting panel 12, when secured thereto to protect the components or other items contained therein from both the elements and unauthorized access. The cover 14 has a pair of opposed sides 50, a top portion 52, a bottom portion 54, and a front portion 56. In this embodiment, the front portion 56 includes a plurality of holes 57 which form a pattern to allow sound to be emitted from the speaker 18. It is to be understood however that the shape and size of the mounting panel 12 and/or the cover 14 may vary significantly from the embodiment shown and still remain within the spirit of the invention.

A generally rectangular tang 58 is located on each of the opposed sides 50 so as to project inwardly generally transverse to said opposed sides. The tangs 58 are oriented within the cover so as to movably cooperate with the slots 36 in each of the corresponding opposed sides 20 of the mounting panel 12. As shown in detail in FIGS. 3 through 3D, this cooperation between the tang 58 and the slot 36 enables the cover 14 to selectively envelop and be removed from the mounting panel 12 which is secured to the adjacent wall AA.

Figure 3A:
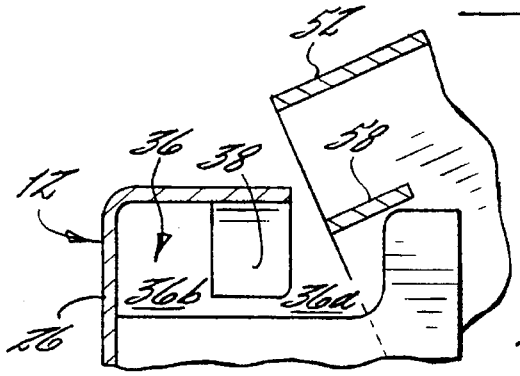
FIGS. 3A–3D are an enlarged side view partially in cross section of the slot and tang of the mounting plate and cover showing the progression of steps to secure the cover to the mounting panel.
Figure 3B:
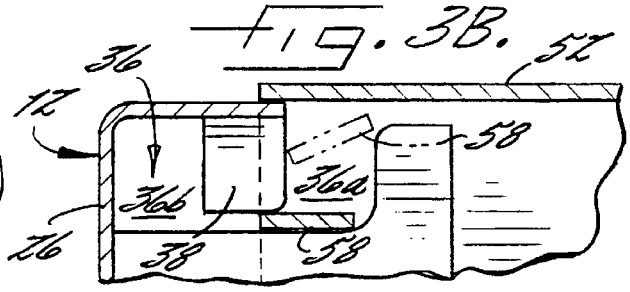
Figure 3C:
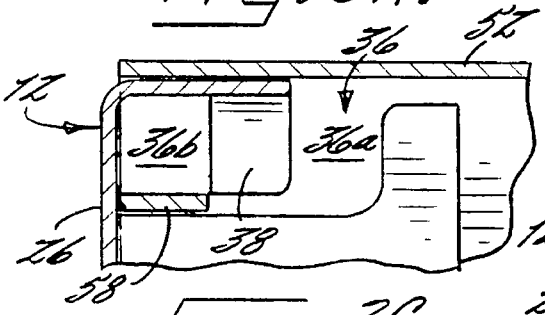
Figure 3D:
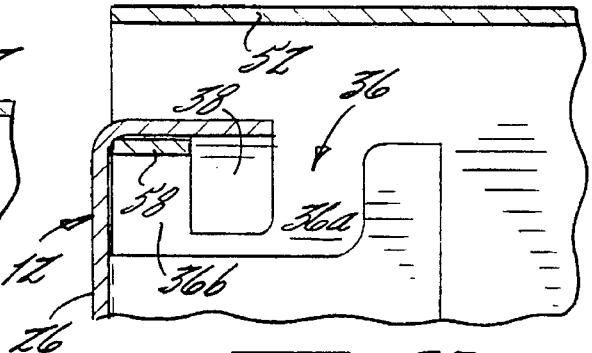

By following the sequence of FIGS. 3A through 3D, it may be seen that for the cover 14 to engage the mounting panel 12 and be secured thereto requires the cover to be tipped in the manner shown in FIGS. 3 and 3A. By tipping the cover 14, the tang 58 fits into the space formed by the cutaway 49 and the corresponding slot 36. A first portion **36*a* of the slot 36 extends generally perpendicular to the back portion 26 of the mounting panel to allow the tang to enter into the slot 36 and provide interconnection between the cover and the mounting panel upon movement of the cover in a first direction generally toward the back portion 26 of the mounting panel. The slot also has a second portion 36*b* connected to the first portion 36*a* for slidably receiving the tang from the first portion. The second portion of the slot extends generally parallel to the back portion 26 of the mounting panel for permitting movement of the cover in a second direction generally parallel to the face of the cover and into a locked position preventing the cover from being removed from the mounting panel. Once the tang 58 has been received within the first portion of the slot 36, the cover is pivoted downward, or clockwise as shown in FIG. 3, to position the tang in the generally horizontal position shown in FIG. 3B. The cover 14 is then pushed toward the adjacent wall AA so as to envelop the mounting panel 12 and move the tang 58 toward the mounting surface i.e., passed the blocking tab 38 and into the second portion 36*b* of the slot 36 as shown in FIG. 3C**.

In this position, a second opening 60 defined in the bottom portion 54 of the cover 14 is in general longitudinal alignment with the first opening 40 in the mounting panel 12 such that the cover fastener 44 may be threadingly inserted therein to draw the cover 14 upward toward the mounting panel 12 as the cover fastener is tightened. The cover fastener 44 is threaded for threadably securing the cover to the mounting panel. The cover fastener 44 is oriented so as to cause the cover to be moved toward the locked position. As a result of this upward movement of the cover 14 relative to the mounting panel 12, the tang 58 moves parallel to the mounting surface, in this instance upward within the second portion **36*b* of the slot 36 until it abuts the top portion 22 of the mounting panel. The cover 14 is now secured to the mounting panel 12 and envelops it to prevent unwanted tampering and/or access to the alarm device, such as the speaker 18 within the cover. To remove the cover 14 from the mounting panel 12 for performing routine maintenance, repair or replacement of any of the components therein, the sequence of above-described steps are repeated in reverse order. In another embodiment of the present invention, it is possible to remove the alarm device and electrical components and rely on the configuration of the mounting panel 12 and the cover 14** to prevent unwanted access to the components housed therein.

In still another embodiment of the present invention, the trigger mechanism 16, includes a trigger member 17 which is mounted to the mounting panel 12 by a pair of pins 62 press fit into a pair of generally circular holes 64 defined in the mounting panel 12 and a corresponding pair of holes 66 defined in the trigger member 17. Because the trigger member 17 is attached at only one end thereof, the trigger member is considered to float or be movable, i.e, can be angularly displaced from an ARMED position shown in FIG. 4A to a position shown in FIG. 5. A compression spring 69 is press fit over the insert 70 so as to extend over the head of the adjustment screw 68 to assist in angularly displacing the trigger member 17. It is to be understood that the spring 69 enhances the angular displacement of the trigger mechanism 17, but is not essential to its operation.

An adjustment screw 68 is threadingly fitted through an insert 70 in turn fitted around an opening 72 located in the trigger member 17. The adjustment screw 68 is adjusted so that it passes through the rectangular aperture 34 in the mounting panel 12 so as to engage or abut the adjacent wall AA, thereby forcing the trigger member 17 to its ARMED position, away from the adjacent wall and into engagement with a flange 74 mounted to the mounting panel.

Figure 4A:
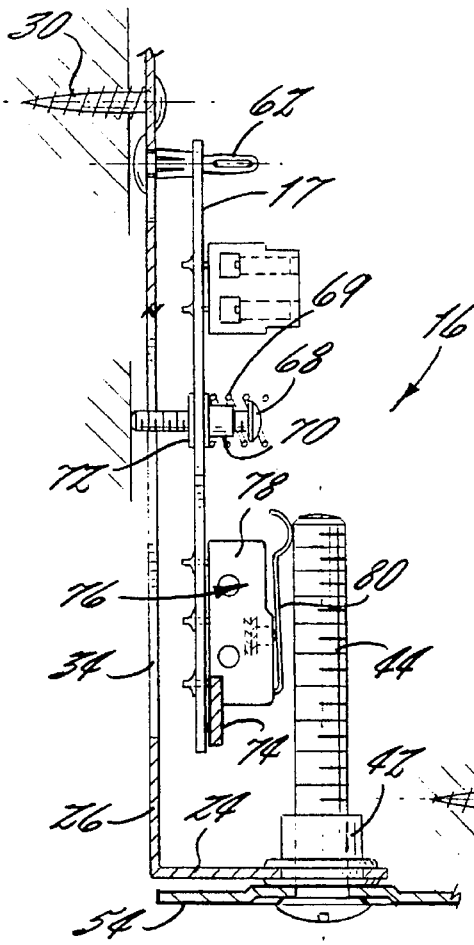
FIG. 4A is a partial side view partially in cross section showing the box in the armed position, such that the cover fastener is securing the cover to the mounting panel and thereby overcoming the bias of the microswitch moving it to the CLOSED position and the adjustment screw is biasing the floating trigger member toward its ARMED position away from the adjacent wall.
Figure 4B:
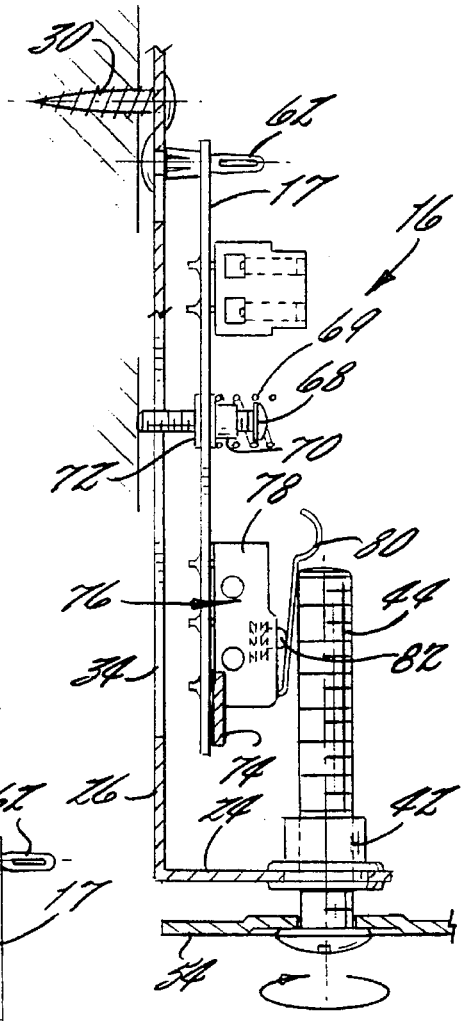
FIG. 4B is a partial side view partially in cross section similar to that shown in FIG. 4A showing the cover fastener being partially removed which causes the microswitch to move to the OPEN position and activate the alarm device indicating an unauthorized attempt to access the box.
Figure 5:
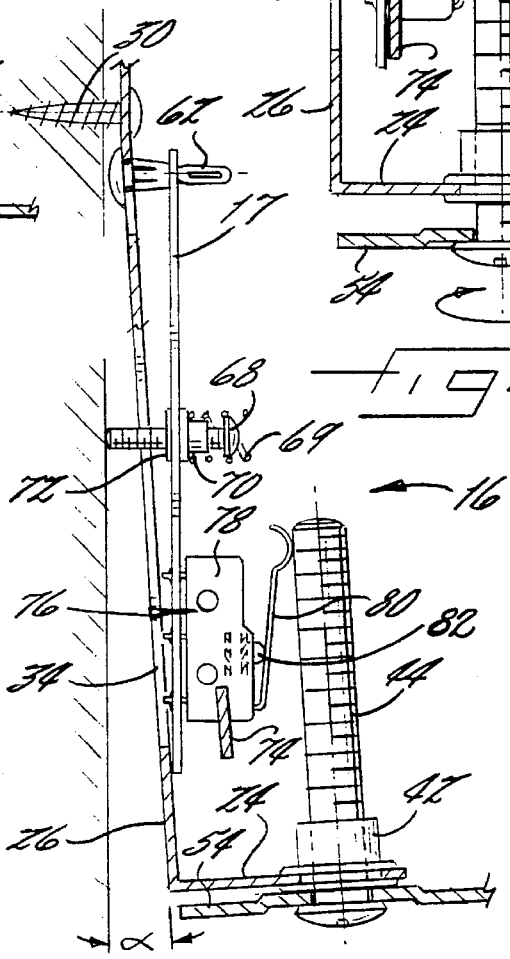
FIG. 5 is a partial side view partially in cross section similar to that shown in FIG. 4A showing the trigger member being angularly displaced from its vertical position causing the microswitch to move to the OPEN position and activate the alarm device as a result of an unauthorized attempt to pry the box from the adjacent wall.

As shown in FIGS. 2, 4A, 4B, and 5, the trigger mechanism 16 has a microswitch, generally indicated as 76 connected thereto. The microswitch 76 has a body portion 78 mounted to the trigger member 17 and a biasing member in the form of a lever 80 extending outward from the body. The lever 80 has a bulbous head located at a free end thereof. The lever 80 is biased outward by a button 82, which in turn is biased in an extended position. As a result, the microswitch 76 is biased to an OPEN position shown best in FIG. 4B wherein an electrical circuit between the microswitch and an alarm device such as a warning light or sound at a remote location is broken. The lever 80, as shown in FIG. 4A is also movable to an CLOSED position wherein the electrical circuit is completed.

FIG. 4A shows the trigger member 17 in the ARMED position and the lever in the CLOSED position. This arrangement is attained by setting the adjusting screw 68 away from the wall AA and securing the cover 14 to the mounting panel 12 by threading the cover fastener 44 into the first opening 40 and the second opening 60 so that the cover fastener engages the bulbous head of the lever 80 moving it to the CLOSED position.

Once the box 10 has been set as shown in FIG. 4A, any attempt to unthread the cover fastener 44 to tamper with the box will cause the cover fastener to move downward from the position shown in FIG. 4A to the position in FIG. 4B. As few as three turns of the cover fastener 44 will cause the cover fastener to move out of engagement with the bulbous head of the lever 80 and cause the lever of the microswitch 76 to move away from the body 78. Consequently, the button 82 extends, thereby causing the microswitch to move from the CLOSED position to the OPEN position shown in FIG. 4B. As the microswitch 76 moves to the OPEN position, the alarm device (either a local alarm device or connected to a central alarm device) will be activated, and in this case, cause the speaker 18 to sound warning of the unauthorized tampering.

Alternatively, if someone attempts to pry the box 10 from the adjacent wall AA, the loose fit of the trigger member 17 on the pins 62 will cause the trigger member to move toward the adjacent wall AA as the distance between the adjacent wall and the mounting panel 12 increases. As a result, the trigger member 17 will be angularly displaced from the ARMED position shown in FIG. 4A to a position similar to that shown in FIG. 5. Because the trigger member 17 has moved toward the adjacent wall AA, the pressure on the lever 80 is lessened or removed which results in the microswitch moving to the OPEN position, and again causing the alarm device to be activated. Therefore, any attempt to tamper with the box 10 or obtain unauthorized access to the components contained therein will activate the alarm device 18 to warn of this unauthorized activity.

Many modifications and other embodiments of the invention will come to mind in one skilled in the art to which this invention pertains having the benefit of the teachings presented in the foregoing descriptions and the associated drawings. Therefore, it is to be understood that the invention is not to be limited to the specific embodiments disclosed. Although specific terms are employed, they are used in a generic and descriptive sense only and not for purposes of limitation, and that modifications and embodiments are intended to be included within the scope of the claims.

That which is claimed:

1. A box for housing components and for preventing unwanted access thereto, said box comprising:

a mounting panel adapted to be secured to a mounting surface;

a cover cooperating with said mounting panel to form an enclosure;

a cover fastener engaging said mounting panel and said cover for securing said cover to said mounting panel;

an alarm device mounted within said enclosure; and a trigger mechanism operably connected to said alarm device for activating said alarm device in response to tampering, said trigger mechanism including a trigger member mounted for movement within said enclosure and a switch carried by said trigger member and operatively connected to said alarm device for activating said alarm device responsive to attempted removal of said cover fastener and also responsive to attempted detachment of said mounting panel from a mounting surface.

2. A box in accordance with claim 1 wherein said switch is positioned for engagement by said cover fastener; and wherein said trigger mechanism further comprises a biasing member carried by said trigger and having a portion thereof projecting from said mounting panel for engaging the mounting surface to which said mounting panel is secured and biasing said movable trigger to a position in which said switch is engaged by said cover fastener so that either detachment of said mounting panel from its mounting surface or movement of said cover fastener away from said switch will result in disengagement of said switch and resulting activation of said alarm device.

3. A box in accordance with claim 2 wherein said cover fastener comprises a threaded fastener threadably securing said cover to said mounting panel, and wherein said threaded fastener is oriented so that an end portion of the fastener engages said switch and so that unthreading of the fastener produces movement of the fastener away from the switch.

4. A box in accordance with claim 2 wherein said biasing member comprises an adjustment screw threadably engaging said trigger and having an end portion thereof projecting outwardly from said mounting panel for engaging the mounting surface to which said mounting panel is secured and biasing said trigger.

5. A box in accordance with claim 4 wherein said trigger comprises a circuit board positioned in generally parallel, spaced apart relation from said mounting panel, a fastener cooperating with one end portion of said circuit board for mounting said circuit board for pivotal movement to said mounting panel, said switch being mounted to said circuit board adjacent an opposite end portion of said circuit board, and wherein said adjustment screw passes through said circuit board and is threadably connected thereto so that rotation of said adjustment screw moves said end portion of said adjustment screw outwardly from the mounting panel for pivotally biasing the circuit board away from said mounting panel.

6. A box in accordance with claim 1 wherein said mounting panel comprises a pair of opposed sides, a top portion, a bottom portion, a back portion, and a mounting means for securing said mounting panel to its mounting surface, and a first opening defined in said mounting panel for receiving said mounting means, and wherein said cover comprises a pair of opposed sides, a top portion, a bottom portion, and a front portion, a second opening defined in said cover for receiving said mounting means when said mounting panel is connected to said cover.

7. A box in accordance with claim 6 including connecting means provided on said mounting panel and said cover for releasably connecting said cover to said mounting panel.

8. A box in accordance with claim 7 wherein said connecting means comprises a tang located in one of said mounting panel and said cover and a corresponding slot formed in the other of said mounting panel and said cover, said slot having a first portion for receiving said tang and providing interconnection between said cover and said mounting panel upon movement of said cover in a first direction, and said slot having a second portion connected to said first portion for slidably receiving said tang from said first portion for permitting movement of said cover in a second direction into a locked position preventing said cover from being removed from said mounting panel.

9. A box for housing components and for preventing unwanted access thereto, said box comprising:

a mounting panel having a back portion adapted to be secured to a mounting surface;

a cover cooperating with said mounting panel to form an enclosure;

connecting means for releasably connecting said cover and said mounting panel, said connecting means comprising a tang located in one of said mounting panel and said cover and a corresponding slot formed in the other of said mounting panel and said cover, said slot having a first portion extending generally perpendicular to said back portion of said mounting panel for receiving said tang and providing interconnection between said cover and said mounting panel upon movement of said cover in a first direction generally toward said back portion of said mounting panel, and said slot having a second portion connected to said first portion for slidably receiving said tang from said first portion, said second portion of said slot extending generally parallel to said back portion of said mounting panel for permitting movement of said cover in a second direction generally parallel to said back portion of said cover and into a locked position preventing said cover from being removed from said mounting panel; and a threaded cover fastener threadably engaging said mounting panel and said cover for securing said cover to said base, said cover fastener being so oriented as to cause said cover to be moved relative to said base in said second direction toward said locked position upon rotation of the threaded fastener in a predetermined direction of rotation.

10. A box in accordance with claim 9 wherein said mounting panel comprises a pair of opposed sides, a top portion, a bottom portion, a back portion, and a fastener for securing said mounting panel to its mounting surface, and a first opening defined in said mounting panel for receiving said cover fastener, and wherein said cover comprises a pair of opposed sides, a top portion, a bottom portion, and a front portion, a second opening defined in said cover for receiving said cover fastener when said mounting panel is connected to said cover.

11. A box in accordance with claim 9 wherein said connecting means comprises a pair of said slots provided on opposing sides of said mounting panel, and a corresponding pair of said tangs provided on opposing sides of said cover.

12. A box for housing components and for preventing unwanted access thereto, said box comprising:

a mounting panel having a back portion adapted to be secured to a mounting surface, a pair of opposed side portions extending generally perpendicular from said back portion along opposite sides thereof, and opposing top and bottom portions extending generally perpendicular from said surface along the top and bottom thereof;

a cover having a front, a pair of opposing side portions extending generally perpendicular from said front along opposite sides thereof, and opposing top and bottom portions extending generally perpendicular from said front along the top and bottom thereof, said cover having dimensions such that said side portions and top and bottom portions surroundingly envelop the corresponding side portions and top and bottom portions of said mounting panel to form an enclosure;

connecting means for releasably connecting said cover and said mounting panel, said connecting means comprising a pair of tangs located on opposite side portions of said cover and a corresponding pair of slots located on opposite side portions of said mounting panel, each said slot having a first portion extending generally perpendicular to said back portion of said mounting panel for receiving said tang and providing interconnection between said cover and said mounting panel upon movement of said cover in a first direction generally toward said back portion of said mounting panel, and having a second portion connected to said first portion for slidably receiving said tang from said first portion, said second portion of said slot extending generally parallel to said back portion of said mounting panel for permitting movement of said cover in a second direction generally parallel to said back portion of said cover and into a locked position preventing said cover from being removed from said mounting panel; and a threaded cover fastener threadably engaging said mounting panel and said cover for securing said cover to said panel, said threaded fastener being so oriented as to cause said cover to be moved in said second direction toward said locked position upon rotation of said threaded fastener in a predetermined direction of rotation;

an alarm device mounted within said enclosure; and a trigger mechanism operably connected to said alarm device for activating said alarm device in response to tampering, said trigger mechanism including means responsive to attempted removal of said cover fastener and also responsive to attempted detachment of said mounting panel from a mounting surface for activating said alarm device.

13. A box in accordance with claim 12 wherein said trigger mechanism comprises:

a trigger mounted for movement within said enclosure;

a switch carried by said trigger and operatively connected to said alarm device for activating the alarm device, said switch being positioned for engagement by said cover fastener; and a biasing member carried by said trigger and having a portion thereof projecting from said mounting panel for engaging the mounting surface to which said mounting panel is secured and biasing said movable trigger to a position in which said switch is engaged by said cover fastener so that either detachment of said mounting panel from its mounting surface or movement of said cover fastener away from said switch will result in disengagement of said switch and resulting activation of said alarm device.

* * * * *